US009431767B2

(12) United States Patent
Wu et al.

(10) Patent No.: US 9,431,767 B2
(45) Date of Patent: Aug. 30, 2016

(54) ELECTRICAL CONNECTOR WITH AN IMPROVED SHELL HAVING A VERTICAL BLADE TO PERFORM A SHIELDING FUNCTION

(71) Applicant: HON HAI PRECISION INDUSTRY CO., LTD., New Taipei (TW)

(72) Inventors: Jerry Wu, Irvine, CA (US); Jun Chen, Kunshan (CN); Zhan-Feng Song, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/458,535

(22) Filed: Aug. 13, 2014

(65) Prior Publication Data

US 2015/0050837 A1 Feb. 19, 2015

(30) Foreign Application Priority Data

Aug. 14, 2013 (CN) ..... 2013 2 0492811 U

(51) Int. Cl.

| | |
|---|---|
| ***H01R 9/03*** | (2006.01) |
| ***H01R 13/6463*** | (2011.01) |
| ***H01R 13/6585*** | (2011.01) |
| ***H01R 13/6592*** | (2011.01) |

(52) U.S. Cl.

CPC ..... *H01R 13/6463* (2013.01); *H01R 13/6585* (2013.01); *H01R 13/6592* (2013.01)

(58) Field of Classification Search

CPC ..... H01R 13/447; H01R 13/506; H01R 13/6461; H01R 13/6463; H01R 13/648; H01R 13/652; H01R 13/655; H01R 13/658; H01R 13/6581; H01R 13/6585; H01R 13/6586; H01R 13/659; H01R 13/6593; H01R 13/66

USPC ..... 439/660, 578, 579, 494, 495, 497, 498, 439/499, 941, 607.41, 607.47, 607.48, 439/607.51, 607.54, 607.55, 607.56

See application file for complete search history.

(56) References Cited

U.S. PATENT DOCUMENTS

| | | | | |
|---|---|---|---|---|
| 4,648,665 | A * | 3/1987 | Davis et al. | 439/108 |
| 4,795,857 | A * | 1/1989 | McInnis | H01R 13/5213 174/138 F |
| 5,114,366 | A * | 5/1992 | Sato | 439/585 |
| 5,605,469 | A * | 2/1997 | Wellinsky | H01R 4/2433 439/417 |
| 5,632,634 | A * | 5/1997 | Soes | 439/101 |
| 5,725,387 | A * | 3/1998 | O'Sullivan et al. | 439/98 |
| 6,793,520 | B1 * | 9/2004 | Wu | 439/459 |
| 6,923,664 | B2 * | 8/2005 | Ito et al. | 439/108 |
| 8,142,226 | B2 | 3/2012 | HonHai | |

(Continued)

*Primary Examiner* — Amy Cohen Johnson
*Assistant Examiner* — Milagros Jeancharles
(74) *Attorney, Agent, or Firm* — Ming Chieh Chang; Wei Te Chung

(57) ABSTRACT

An electrical connector (100) includes an insulative body (1) comprising a rear part (11), a front widened tongue (121), and a front narrowed tongue (122), a plurality of contacts (2) received in the insulative body, a metallic shell (3) enclosing the insulative body, a spacer (5) assembled to the insulative body for supporting the contacts, and a cable connected with the contacts and comprising two STP (Shielded Twisted Pair) wires (62) for high speed signal transmission, each of the two STP wires having a front section without aluminum foil. The metallic shell comprises a front shell (32) and a rear shell (33) assembled with each other, the rear shell defines a vertical blade (335) bent downwards from a top wall thereof, and the vertical blade extends downwards and is located between the front sections of the STP wires.

7 Claims, 6 Drawing Sheets

(56) References Cited

U.S. PATENT DOCUMENTS 8,348,699 B2 * 1/2013 Nagawatari ..... H01R 9/035 439/607.01
8,579,519 B2 * 11/2013 Wu ..... 385/75
8,597,060 B2 * 12/2013 Wu ..... 439/660
2012/0156941 A1 * 6/2012 Wu ..... H01R 13/6585 439/660

* cited by examiner

ELECTRICAL CONNECTOR WITH AN IMPROVED SHELL HAVING A VERTICAL BLADE TO PERFORM A SHIELDING FUNCTION

BACKGROUND OF THE INVENTION

1. Field of the Invention

The present invention relates to the art of electrical connectors, and more particularly to an electrical connector having an improved shell for preventing cross-talk.

2. Description of Related Art

U.S. Pat. No. 8,142,226, issued to Xiao et al. on Mar. 27, 2012, discloses a cable connector assembly in compliance with USB 3.0 standard. The cable connector assembly comprises an insulative housing, a plurality of contacts received in the insulative housing, a metallic shell enclosing the insulative housing, and a pair of latches retained in the insulative housing and exposed out of the metallic shell. Tail portions of the contacts extend beyond a rear end of the insulative housing to be electrically connected with a cable.

The metallic shell of the cable connector assembly comprises a front shell and a back shell assembled to each other along an up-to-down direction. The cable has two high speed signal wires with front aluminum foil thereof stripped away. Cross-talk may occur between two neighboring front segments where there is no aluminum foil.

BRIEF SUMMARY OF THE INVENTION

The present invention provides an electrical connector including an insulative body comprising a backward part, a widened tongue and a narrowed tongue extending forwardly from the backward part, a plurality of contacts received in the insulative body, a metallic shell enclosing the insulative body, a spacer assembled to the insulative body for supporting the contacts, and a cable electrically connected with the contacts and comprising two STP (Shielded Twisted Pair) wires for high speed signal transmission, each of the two STP wires having a front section without aluminum foil. The metallic shell comprises a front shell and a rear shell assembled with each other, the rear shell defines a vertical blade bent downwards from a top wall thereof, and the vertical blade extends downwards and is located between the front sections of the STP wires.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
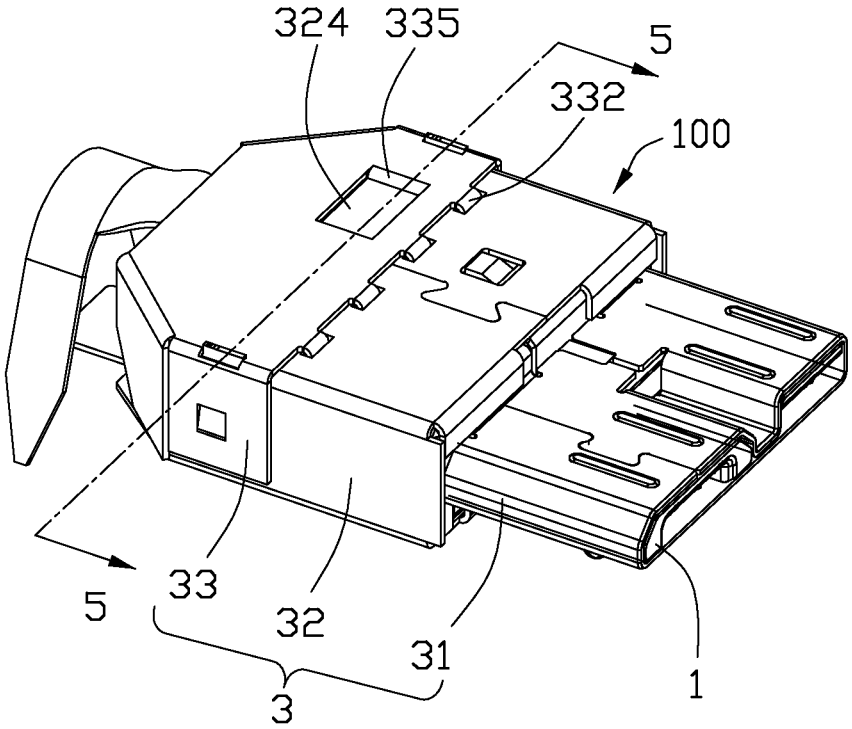
FIG. 1 is an assembled, perspective view of an electrical connector according to a preferred embodiment of the present invention.

Reference will be made to the drawing figures to describe the present invention in detail, wherein depicted elements are not necessarily shown to scale and wherein like or similar elements are designated by same or similar reference numeral through the several views and same or similar terminology.

Figure 2:
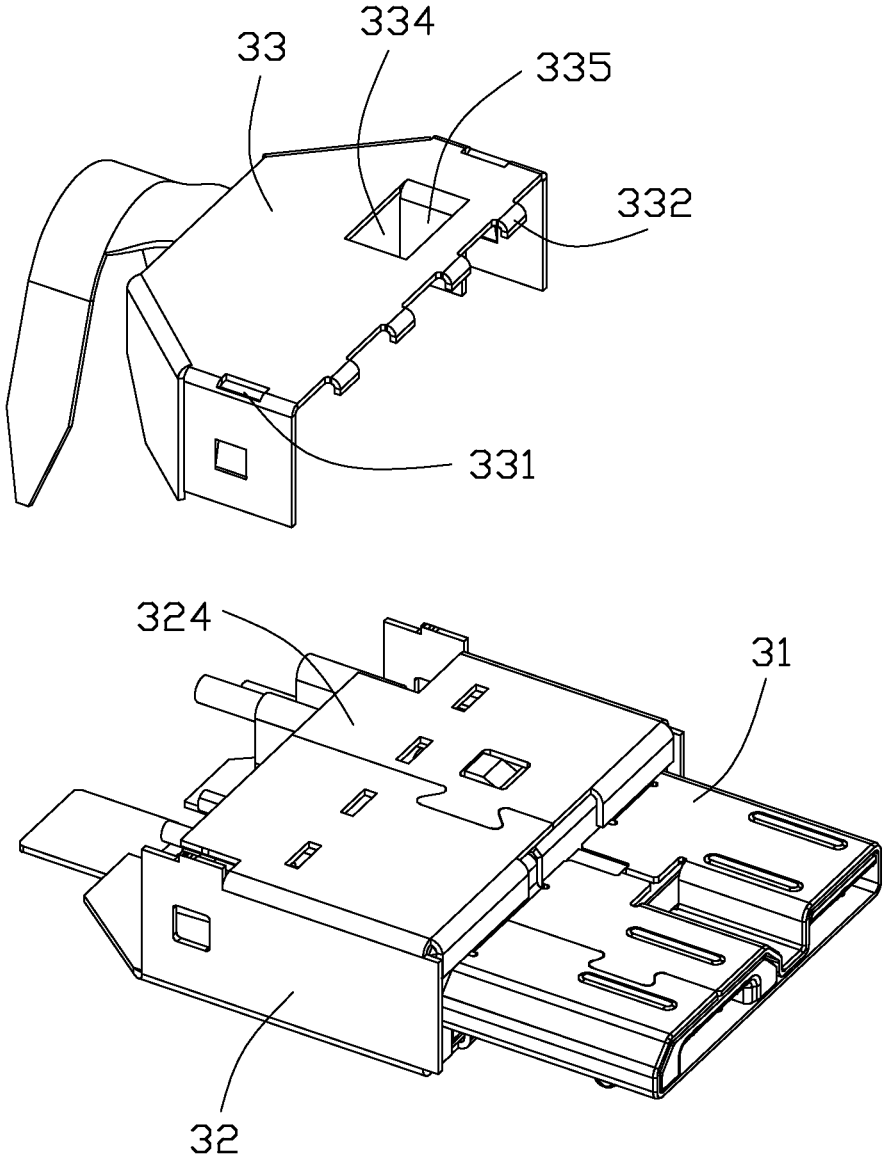
FIG. 2 is a partly-exploded, perspective view of the electrical connector of FIG. 1.
Figure 3:
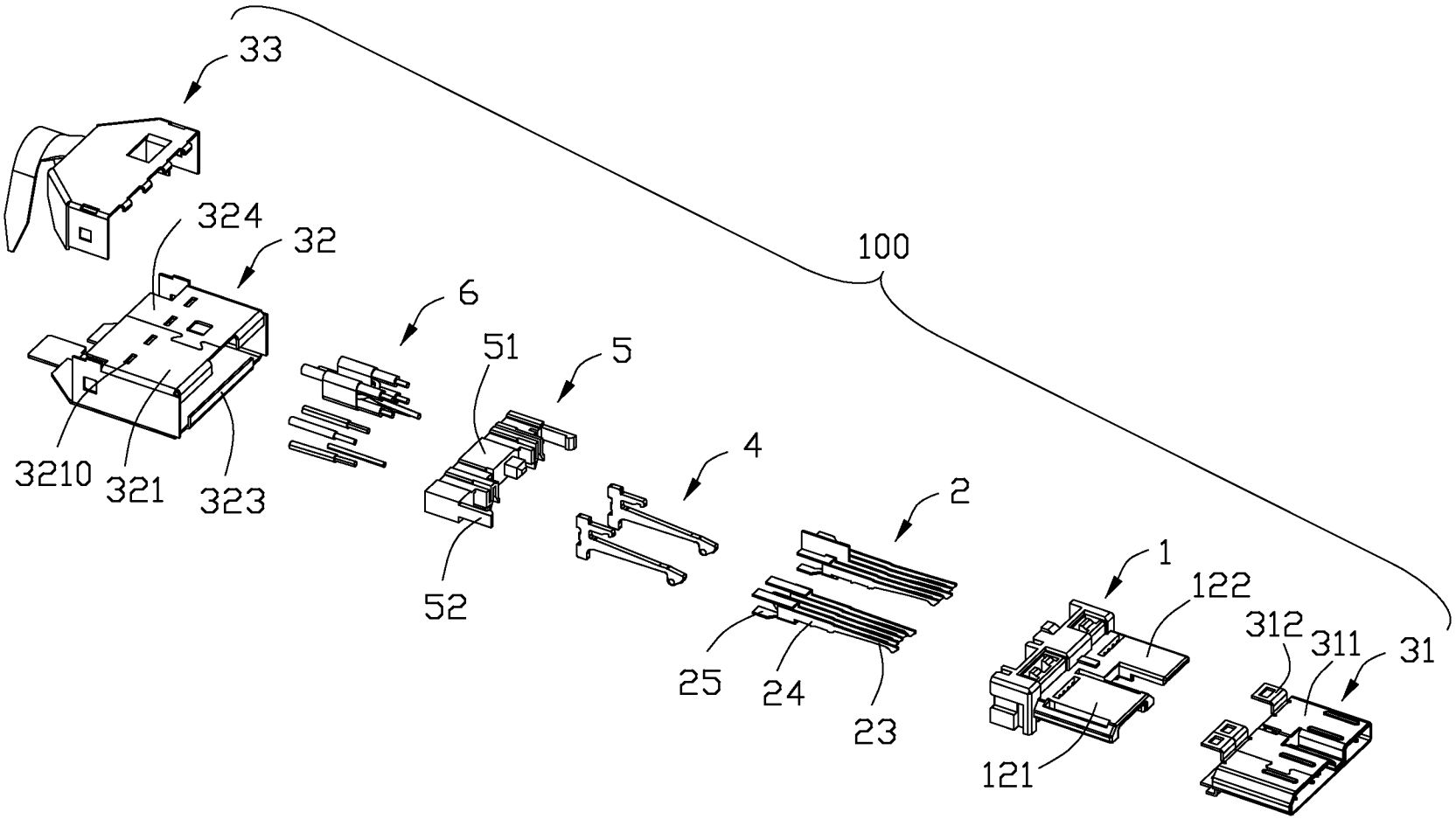
FIG. 3 is an exploded, perspective view of the electrical connector of FIG. 1.
Figure 4:
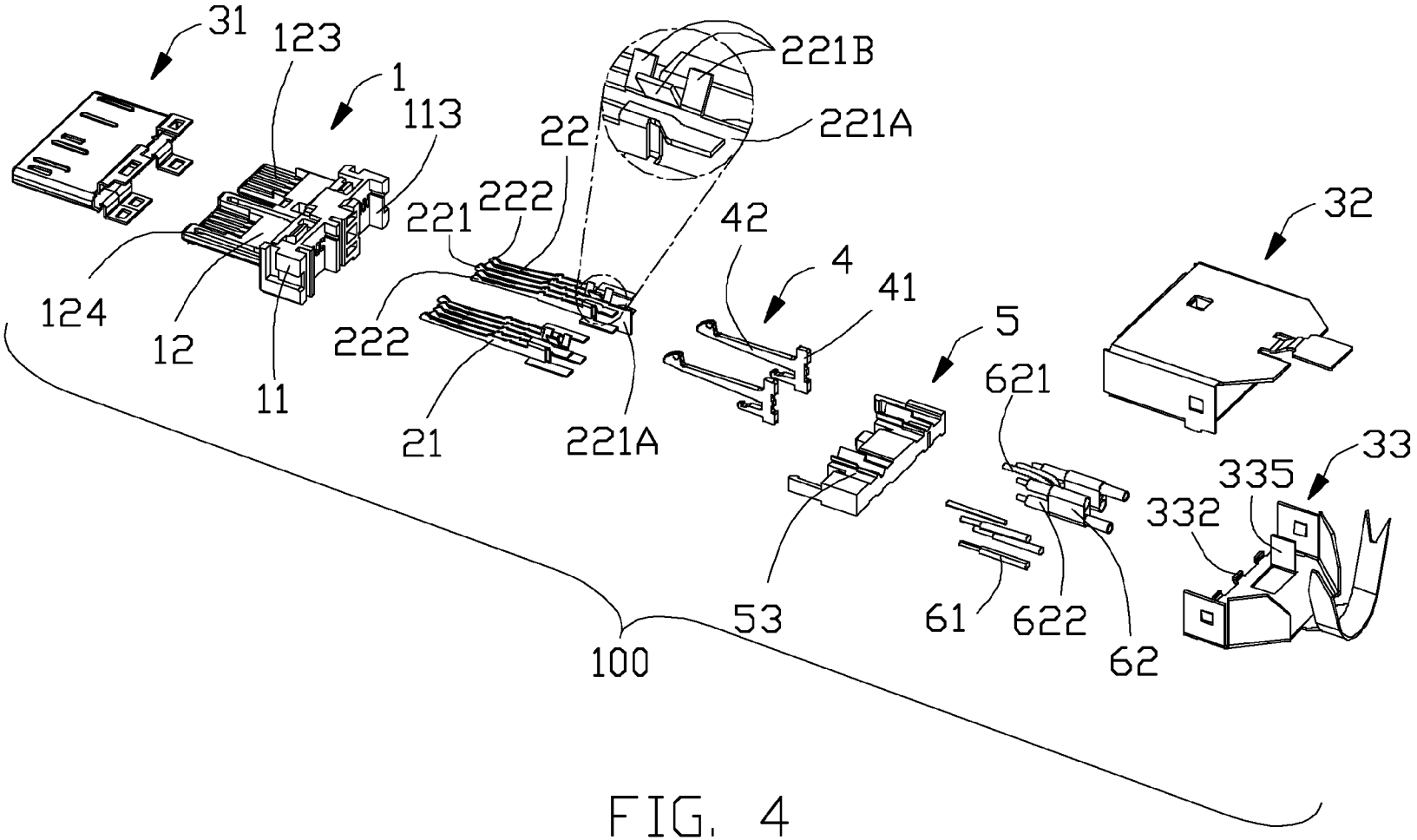
FIG. 4 is similar to FIG. 3, but viewed from another aspect.

Referring to FIGS. 1 to 3, an electrical connector 100 includes an insulative body 1 with a plurality of contact terminals 2 held therein, a metallic shell 3 shield the insulative body 1, a pair of latches 4 retained in the insulative body 1 and exposed out of the metallic shell 3, a spacer 5 fastened to a rear end of the insulative body 1 for supporting the contact terminals 2, and a cable 6 electrically connected with the contact terminals 2.

Referring to FIGS. 2 to 6, the insulative body 1 includes a thick backward part 11 and a thin forward part 12 integrally extending forwardly beyond the backward part 11. The forward part 12 is split into a widened tongue 121 and a narrowed tongue 122 side by side arranged with each other and disposed in a common plane, and the size of the widened tongue 121 is accordance with USB 2.0 standard. The narrowed tongue 122 and the widened tongue 121 are spaced apart from each other by a gap horizontally located therebetween through a front end of the forward part 12. A pair of outlets 113 are recessed forwardly from a rear end of the backward part 11. Both the narrowed tongue 122 and the widened tongue 121 have a plurality of passages 123 extending along a mating direction, and the passages 123 are extending through the backward part 11. A pair of channels 124 are defined on both sides of the widened tongue 121 to receive the latches 4, and the channels 124 are extending through the backward part 11.

The contact terminals 2 include first and second sets of contacts 21, 22 located in the widened tongue 121 and the narrowed tongue 122, respectively. The first contacts 21 are compatible to version 2.0 Micro Universal Serial Bus. That is to say, the definition of the first contacts 21 for signal transmission is compatible to version 2.0 Micro Universal Serial Bus. The first contacts 21 and the second contacts 22 are received in the corresponding passages 123. Each contact terminal 2 includes a contact portion 23 extending along the mating direction, a connecting portion 24 extending backward from the contact portion 23 and a tail portion 25 linked with the connecting portion 24.

The first contacts 21 include five conductive contacts, and the second contacts 22 also include five conductive contacts, and the middle one of the second contacts 22 is a grounding contact 221, a differential pair of signal contacts 222 for transmitting high speed signal and a differential pair of signal contacts 222 for receiving high speed signal are located by both sides of the grounding contact 221. Notably, the grounding contact 221 forms an enlarged vertical plate 221A. A plurality of tabs 221B extend along one edge of the enlarged vertical plate 221A in an alternate/staggered oblique manner so as to form a V like retention groove, viewed along a front-to-back direction, to receive therein the corresponding drain wires 621 (illustrated later) wherein the tabs 221B are offset from one another in the front-to-back direction.

The metallic shell 3 includes a shielding member 31, a front shell 32 and a back shell 33, and the back shell 33 is cooperated with rear section of the front shell 32. The shielding member 31 comprises a front sleeve portion 311 and a plurality of fasteners 312 extending backwards from a back end of the sleeve portion 311, the shielding member 31 has two mating cavities for receiving the widened tongue 121 and the narrowed tongue 122.

The front shell 32 comprises a front pocket 321 with a rectangular box shape, and the pocket 321 defines a row of locking holes 3210 along a transverse direction. The front shell 32 has a plurality of stopping portions 323 on a front end thereof, the stopping portions 323 are bent from two opposite front edges of the front shell 32 and extending along a vertical direction. An extension portion 324 is extending rearwards from an upper wall of the front shell 32, and the extension portion 324 is located behind the locking holes 3210. The extension portion 324 is separated from both side walls of the front shell 32, thus two gaps are formed between the extension portion 324 and the two side walls, and the gap corresponding to the second contacts 22 has a lager width than the gap corresponding to the first contacts 21.

The rear shell 33 comprises a pair of slits 331 on both sides of a top wall thereof and a plurality of teeth 332 on a front end of the top wall, the teeth 332 are inserted into the corresponding locking holes 3210 of the front shell 32 to make the rear shell 33 combined with the front shell 32 securely. A pair of protrusions formed on both side walls of the front shell 32 are inserted into the corresponding slits 331. A vertical blade 335 is stamped downwardly from the top wall of the rear shell 33, thus a rectangular opening 334 is formed after stamping, the vertical blade 335 is perpendicular to the top wall of the rear shell 33. The opening 334 has a same size as the vertical blade 335, and the vertical blade 335 is extending downwards from a side wall of the opening 334.

Each latch 4 comprises a retaining standoff 41 held in the backward part 11 of the insulative body 1 and an engaging arm 42 extending forwards from the retaining standoff 41, the engaging arm 42 is received in the relative channel 124 of the insulative body 1.

The spacer 5 is made of insulative material, and comprises a primary portion 51 and a pair of elongate arms 52 extending forwards from lateral sides of the primary portion 51.

The cable 6 is divided into two groups, and the first group comprises a number of individual wires 61 connected with the first contacts 21, and the second group comprises two STP (Shielded Twisted Pair) wires 62 for high speed signal transmission wherein each STP wire 62 includes a pair of differential wires 622 and a drain wire 621 wrapped within an aluminum foil.

In assembly, the contacts 2 are inserted into the insulative body 1 along a back-to-front direction, the first contacts 21 and the second contacts 22 are accommodated in the corresponding passages 123 of the widened tongue 121 and the narrowed tongue 122 respectively, the latches 4 are inserted into the channels 124 of the widened tongue 121. The tail portions 25 of the contacts 2 are exposed beyond the insulative body 1. Then the spacer 5 is assembled to the rear end of the insulative body 1 along the back-to-front direction, the elongate arms 52 on both sides of the spacer 5 are latched with corresponding sides of the backward part 11. Tail portions 25 of the contacts 2 are exposed beyond the insulative body 1 and received in grooves 53 of the spacer 5.

The individual wires 61 of the cable 6 are soldered to corresponding tail portions 25 of the first contacts 21, the STP wires 62 are electrically connected with the second contacts 22. Front parts of aluminum foils of the STP wires 62 are stripped away to expose corresponding inner conductors.

Then the insulative body 1 is assembled into the shielding member 31, the forward part 12 of the insulative body 1 is received in the sleeve portion 311 of the shielding member 31. The engaging arms 42 of the latches 4 are exposed out of the shielding member 31. Then the aforementioned components are assembled into the front shell 32, the stopping portions 323 on the front end of the front shell 32 are located adjacent to a front end of the backward part 11 of the insulative body 1. The rear shell 33 is mounted to the front shell 32 along an up-to-down direction, the teeth 332 on a front end of the rear shell 33 are inserted into the corresponding locking holes 3210 of the front shell 32. The extension portion 324 of the front shell 32 is extending rearwardly to shield under the opening 334 of the rear shell 33, thus to suppress Electro-Magnetic Interference (EMI). The vertical blade 335 of the rear shell 33 is neighboring to one lateral surface of the extension portion 324 and extending downwards to locate between the two neighboring areas of the STP wires 62 without aluminum foil, thus to reduce cross-talk between the two STP wires 62 furthest. Thus the shielding member 31, the front shell 32, the rear shell 33 and the insulative body 1 are combined to a whole, and the electrical connector 100 is assembled.

Figure 5:
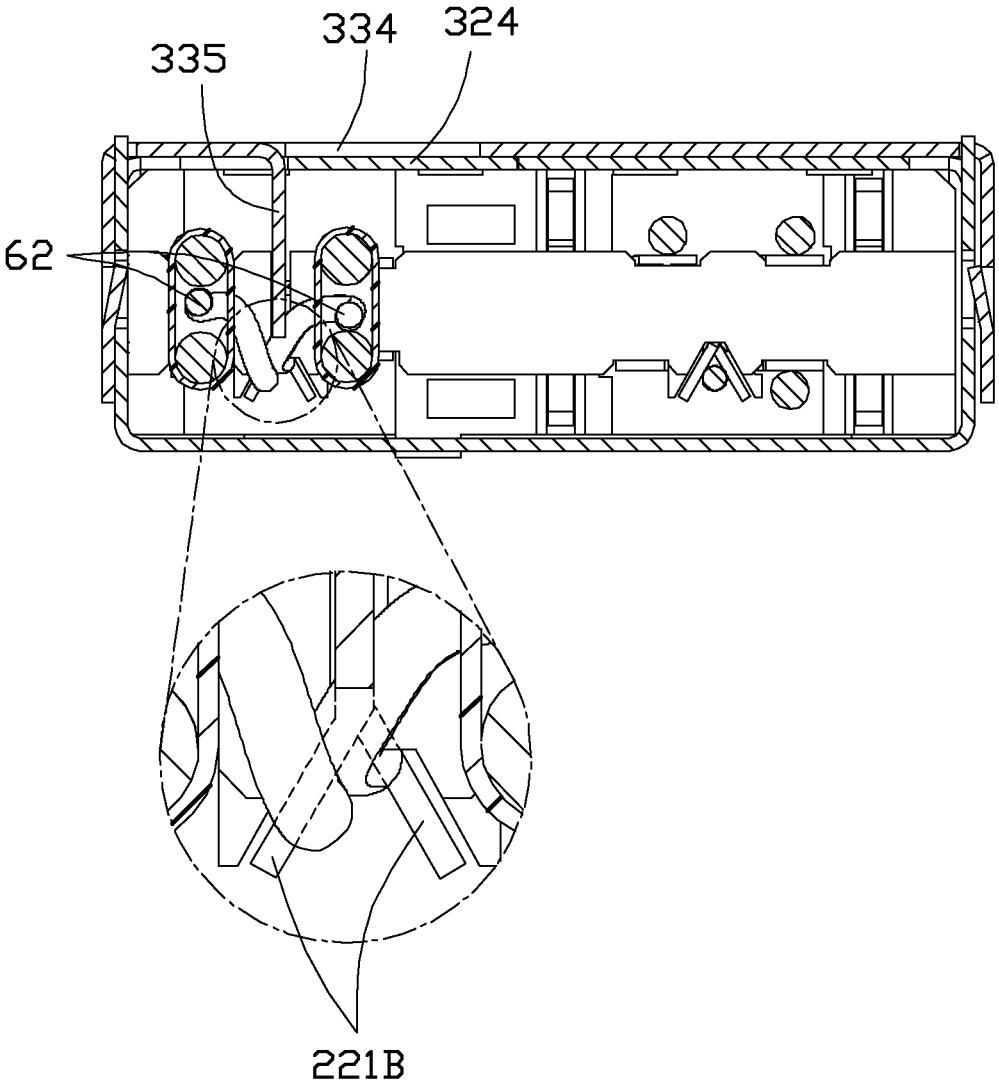
FIG. 5 is a cross sectional view of the electrical connector of FIG. 1, taken along line 5-5 thereof.
Figure 6:
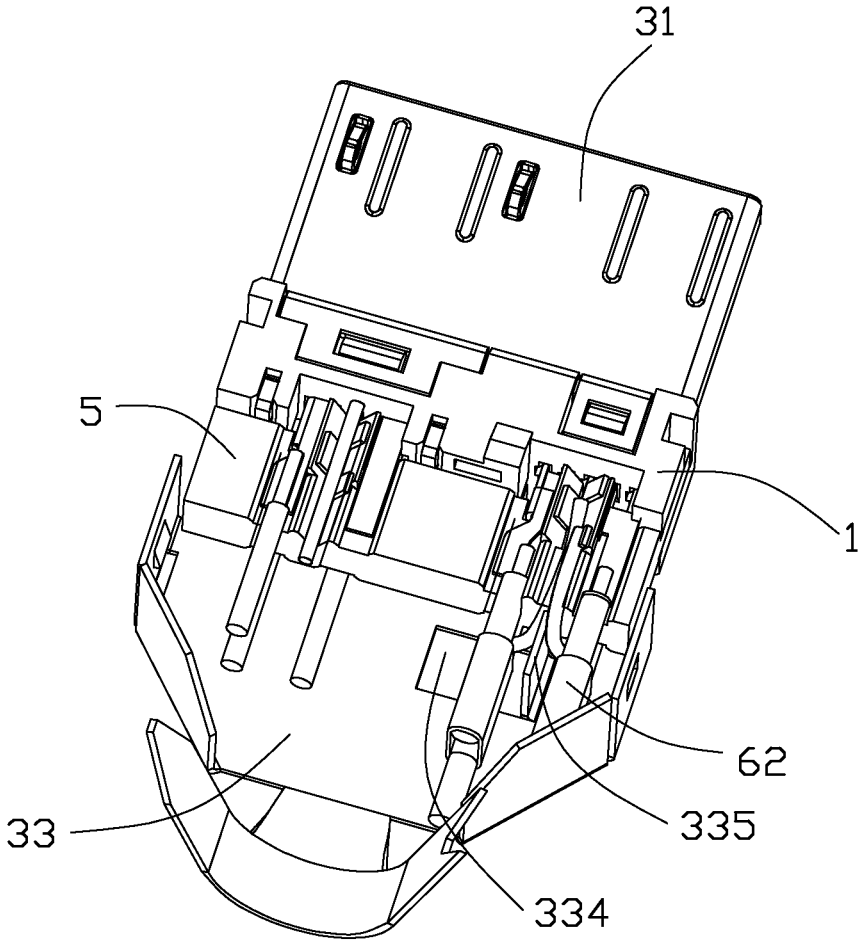
FIG. 6 is another partly-exploded, perspective view of the electrical connector of FIG. 1.

According to the illustrated embodiment of the present invention, the vertical blade 335 of the metallic shell 3 is located between two STP wires 62, therefore to prevent cross-talk and achieve better Electro-Magnetic Interference (EMI) suppressing effect. As shown in FIG. 5, the vertical blade 335 extends with a distance beyond one half of the exposed front portion of each STP wire 62 in the vertical direction for achieving the aforementioned better EMI suppressing effect.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector comprising:

an insulative body comprising a rear part, a front widened tongue, and a front narrowed tongue, the widened tongue and the narrowed tongue arranged side by side with respect to each other;

a plurality of contacts received in the insulative body and held in the widened tongue and the narrowed tongue;

a metallic shell enclosing the insulative body;

a spacer assembled to the insulative body for supporting the contacts; and a cable connected with the contacts and comprising two STP (Shielded Twisted Pair) wires for high speed signal transmission, each of the two STP wires wrapped by an aluminum foil except a front section thereof; wherein the metallic shell comprises a front shell and a rear shell assembled with each other, the rear shell defines a blade bent downwards from a wall thereof, and the blade is located between the front sections of the STP wires;

the front shell defines an extension portion extending rearwards from an upper wall thereof, and the extension portion is separated from both side walls of the front shell; and the rear shell defines an opening on one side of the blade, and the extension portion of the front shell extends rearwardly to shield the opening.

2. The electrical connector as claimed in claim 1, wherein the wall is a top wall and the blade is stamped downwardly and vertically from said top wall of the rear shell to form an opening.

3. The electrical connector as claimed in claim 1, wherein two gaps are formed between the extension portion and the two side walls of the front shell, and the gap corresponding to the narrowed tongue has a larger width than the gap corresponding to the widened tongue.

4. The electrical connector as claimed in claim 1, wherein the blade is neighboring to one lateral surface of the extension portion.

5. The electrical connector as claimed in claim 1, wherein the front shell comprises a rectangular front pocket, the pocket defines a row of locking holes along a transverse direction, and the extension portion is located behind the locking holes.

6. The electrical connector as claimed in claim 1, wherein the rear shell comprises a pair of slits on both sides of a top wall thereof and a plurality of teeth on a front end of the top wall for locking with the front shell.

7. An electrical connector comprising:

an insulative body defining at least one mating port in communication with an exterior along a front-to-back direction;

a plurality of contacts disposed in the housing and including two pairs of differential pair contacts commonly sandwiching a grounding contact therebetween in a transverse direction perpendicular to said front-to-back direction, each of said contacts defining a front mating section and a rear connecting section;

a cable enclosing two STP (Shielded Twisted Pair) wires each including differential pair wires and a drain wire wrapped within a shielding foil except a front portion, wherein front sections of the differential pair wires are respectively mechanically and electrically connected to the rear connecting sections of the corresponding differential pair contacts while the drain wire is mechanically and electrically connected to the rear connecting section of said grounding contact; and a metallic shell enclosing said housing and a front portion of the cable; wherein said shell unitarily forms a blade extending into a space between the exposed front portions of said two STP wires in said transverse direction, where no shielding foils exists, to reduce crosstalk between said two STP wires; wherein the blade extends with a distance beyond one half of the exposed front portion of each of said two STP wires at least partially in a vertical direction which is perpendicular to both said front-to-back direction and said transverse direction; wherein the shell includes a front part and a rear part, the blade is stamped from the shell part with a corresponding through opening in the vertical direction while the front shell forms a rearward extension to shield said through opening in said vertical direction.

* * * * *